US008833500B2

(12) United States Patent
Nakamura et al.

(10) Patent No.: US 8,833,500 B2
(45) Date of Patent: Sep. 16, 2014

(54) WORK VEHICLE

(75) Inventors: Mitsutaka Nakamura, Komatsu (JP); Shinichi Ohtaka, Komatsu (JP); Kazushi Nakata, Komatsu (JP)

(73) Assignee: Komatsu Ltd., Tokyo (JP)

( * ) Notice: Subject to any disclaimer, the term of this patent is extended or adjusted under 35 U.S.C. 154(b) by 0 days.

(21) Appl. No.: 13/634,482

(22) PCT Filed: Jan. 19, 2012

(86) PCT No.: PCT/JP2012/051067
§ 371 (c)(1),
(2), (4) Date: Sep. 12, 2012

(87) PCT Pub. No.: WO2012/099199
PCT Pub. Date: Jul. 26, 2012

(65) Prior Publication Data

US 2013/0001005 A1 Jan. 3, 2013

(30) Foreign Application Priority Data

Jan. 21, 2011 (JP) ..... 2011-011439

(51) Int. Cl.
*B62D 25/10* (2006.01)
*B62D 25/12* (2006.01)
*E02F 9/08* (2006.01)

(52) U.S. Cl.
CPC ..... *E02F 9/0866* (2013.01); *F01N 2590/08* (2013.01)
USPC ..... 180/69.2; 180/69.24; 180/89.12; 180/89.17

(58) Field of Classification Search
USPC ..... 180/68.1, 69.2, 69.24, 89.12, 89.17, 180/296; 296/193.11, 136.04
See application file for complete search history.

(56) References Cited

U.S. PATENT DOCUMENTS

| | | | | |
|---|---|---|---|---|
| 1,859,331 | A * | 5/1932 | Heaslet | 296/37.7 |
| 3,002,186 | A * | 9/1961 | Schlangen | 340/450.3 |
| 3,583,513 | A * | 6/1971 | Macadam et al. | 180/69.24 |
| 2004/0200649 | A1 * | 10/2004 | Yatsuda et al. | 180/69.2 |
| 2009/0178880 | A1 * | 7/2009 | Uemura et al. | 181/229 |

FOREIGN PATENT DOCUMENTS

| | | | |
|---|---|---|---|
| JP | 6-34062 | U | 5/1994 |
| JP | 2003-313903 | A | 11/2003 |
| JP | 2008-156835 | A | 7/2008 |
| WO | WO 2010/013537 | A1 | 4/2010 |

* cited by examiner

*Primary Examiner* — Hau Phan
*Assistant Examiner* — Bryan Evans
(74) *Attorney, Agent, or Firm* — Global IP Counselors, LLP

(57) ABSTRACT

A work vehicle includes an engine compartment, an engine, an exhaust gas treatment device, an air cleaner, and an intake pipe. The engine compartment has a first sidewall, a second sidewall and an upper cover. The first sidewall and the second sidewall are set at a distance from each other in a vehicle width direction. The upper cover is disposed on the first sidewall and the second sidewall, and constituting a tool-storage part. The engine is disposed in the engine compartment. The exhaust gas treatment device is disposed above the engine in the engine compartment. The air cleaner is disposed above the engine in the engine compartment and rearward of the exhaust gas treatment device. The intake pipe is connected to the air cleaner in the engine compartment and protruding upward from the upper cover. The tool-storage part is disposed rearward of the intake pipe.

9 Claims, 7 Drawing Sheets

WORK VEHICLE

CROSS-REFERENCE TO RELATED APPLICATIONS

This application claims priority to Japanese Patent Application No. 2011-011439 filed on Jan. 21, 2011, the disclosure of which is hereby incorporated herein by reference in its entirety.

TECHNICAL FIELD

The present invention relates to a work vehicle comprising an exhaust gas treatment device.

BACKGROUND AU

There has been known in the art a technique for installing a tool-storage part in an engine compartment of a bulldozer or other work vehicle, as a technique for storing a tool box (hereinbelow referred to as "tool-storage part") in a vehicle. Tools used for inspecting and servicing various pieces of equipment stored in the engine compartment are accommodated in the tool-storage part.

Also, in recent years, exhaust gas treatment devices for cleaning exhaust gas have been mounted in the engine compartment for environmental conservation purposes (e.g., see Japanese Laid-open Patent Application No. 2008-156835). The exhaust gas treatment device is, for example, a device for reducing nitrogen oxides (NOx), a device for reducing carbon monoxide (CO), a device for reducing particulate matter, or another device.

SUMMARY

However, the exhaust gas treatment device described in Patent Document 1 tends to reach higher temperatures than conventional muffler devices, and the tool-storage part installed in the engine compartment is therefore liable to overheat.

In view of the circumstances described above, an object of the present invention is to suppress excess heat in a tool-storage part produced by an exhaust gas treatment device in a work vehicle.

A work vehicle according to a first aspect of the present invention comprises: an engine compartment having a first sidewall, a second sidewall and an upper cover, the first sidewall and the second sidewall being set at a distance from each other in a vehicle width direction, the upper cover disposed on the first sidewall and the second sidewall and constituting a tool-storage part; an engine disposed in the engine compartment; an exhaust gas treatment device disposed above the engine in the engine compartment; an air cleaner disposed above the engine in the engine compartment and rearward of the exhaust gas treatment device; and an intake pipe connected to the air cleaner in the engine compartment and protruding upward from the upper cover. The tool-storage part is disposed rearward of the intake pipe.

In the work vehicle according to the first aspect of the present invention, the tool-storage part is set at a distance from the exhaust gas treatment device. In particular, the intake pipe is disposed between the tool-storage part and the exhaust gas treatment device. Accordingly, it is possible to suppress the transfer of heat generated from the exhaust gas treatment device to the tool-storage part, even when the exhaust gas treatment device has reached a high temperature. Therefore, the tool-storage part can be kept from overheating.

A work vehicle according to a second aspect of the present invention is the work vehicle according to the first aspect, wherein the upper cover has an opening and a lid, the opening leading to the tool-storage part, and the lid being capable of opening and closing the opening.

In accordance with the work vehicle according to the second aspect of the present invention, the tool-storage part can be directly accessed from the exterior of the engine compartment; accordingly, there is no need to remove the upper cover. Accordingly, work efficiency can be improved.

A work vehicle according to a third aspect of the present invention is the work vehicle according to the second aspect, wherein the opening is disposed above the first sidewall; and at least one among an element replacement port for the air cleaner, a fuel filter cartridge, and an engine oil level gauge (hereinafter generically referred to as "serviceable equipment") is disposed on the inside of the first sidewall.

In accordance with the work vehicle according to the third aspect of the present invention, the opening is disposed in a location in which the serviceable equipment is concentrated, and the distance that the worker moves during inspection and service can be reduced. Accordingly, work efficiency can be further improved.

A work vehicle according to a fourth aspect of the present invention is the work vehicle according to any of the first to third aspects, wherein the upper cover has a top plate, a first side plate, a second side plate and a first coupling plate, the top plate covering over the exhaust gas treatment device and the air cleaner, the first side plate leading to the top plate and disposed between the top plate and the first sidewall, the second side plate leading to the top plate and disposed between the top plate and the second sidewall, and the first coupling plate coupled to the first side plate and the second sidewall below the top plate, the first coupling plate constituting a bottom plate of the tool-storage part.

In the work vehicle according to the fourth aspect of the present invention, the bottom plate of the tool-storage part is used as a reinforcement member; therefore, it is not necessary to separately provide a reinforcement member.

A work vehicle according to a fifth aspect of the present invention is the work vehicle according to the fourth aspect, wherein the upper cover has a second coupling plate and a third coupling plate, the second coupling plate coupled to the first side plate and the second sidewall below an upper surface part and erecting in relation to the first coupling plate, the second coupling plate constituting a front plate of the tool-storage part, and the third coupling plate coupled to the first side plate and the second sidewall below the upper surface part and erecting in relation to the first coupling plate, the third coupling plate constituting a rear plate of the tool-storage part.

In accordance with the work vehicle according to the fifth aspect of the present invention, the front plate and rear plate of the tool-storage part are used as reinforcement members; therefore, it is not necessary to separately provide a reinforcement member.

In accordance with the present invention, the tool-storage part can be kept from overheating in a work vehicle.

DESCRIPTION OF THE EMBODIMENTS

Overall Configuration of Bulldozer 1

The configuration of the work vehicle according to an embodiment will be described with reference to the drawings. A bulldozer will be used as an example of the work vehicle in the following description.

Figure 1:
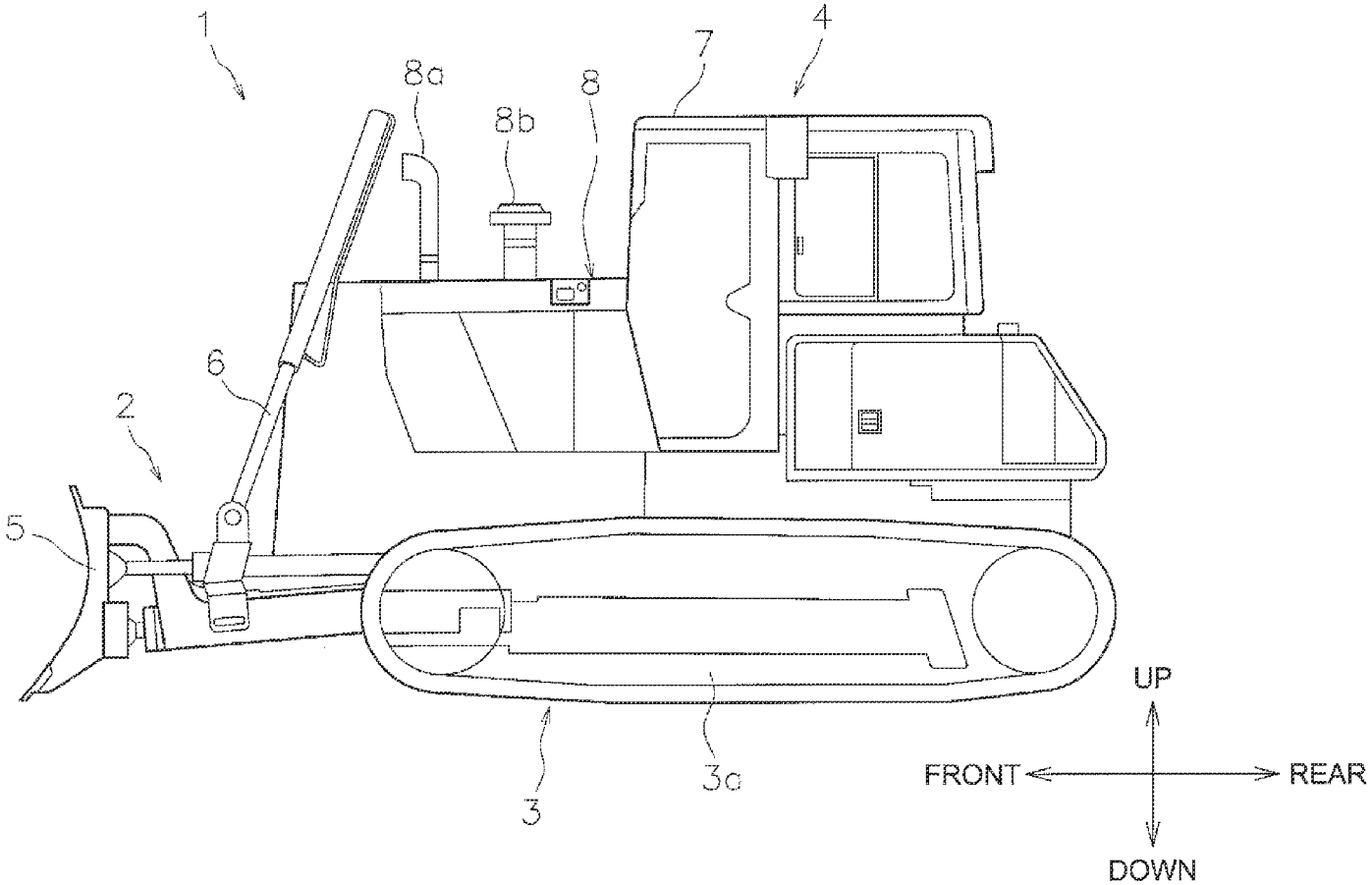
FIG. 1 is a left side view showing the overall configuration of a bulldozer 1 according to an embodiment.
Figure 2:
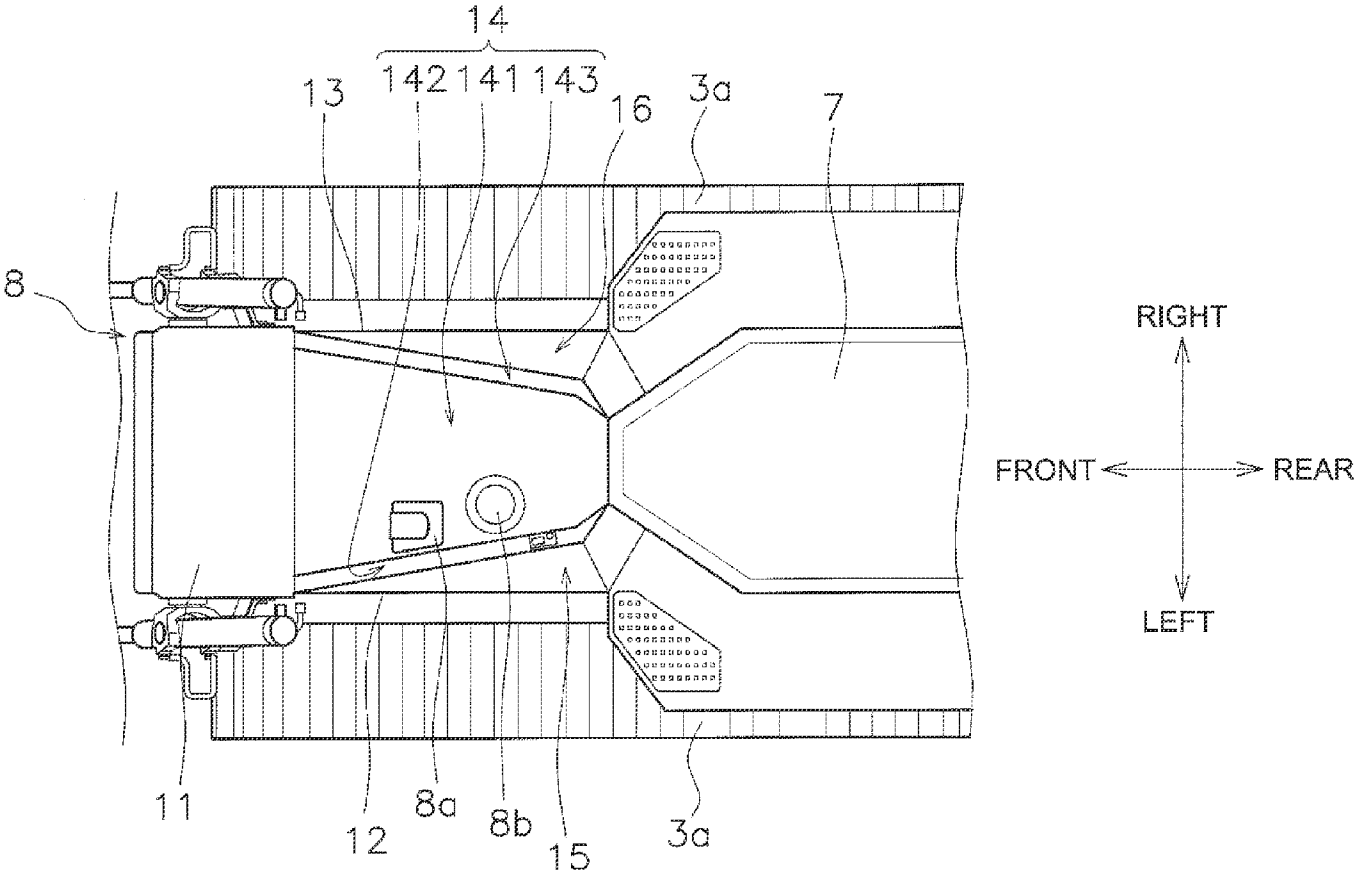
FIG. 2 is a top view showing a portion of the bulldozer 1 according to an embodiment.

FIG. 1 is a left side view showing the overall configuration of a bulldozer 1 according to an embodiment. FIG. 2 is a top view showing a portion of the bulldozer 1 according to an embodiment. In the description below, the terms "left" and "right" are used with reference to an operator seated in a driver's cab 7.

The bulldozer 1 comprises a work machine 2, a travel device 3, and a vehicle body frame 4. The work machine 2 has a blade 5 and a hydraulic cylinder 6. The blade 5 is disposed in front of the vehicle body frame 4. The hydraulic cylinder 6 is driven by hydraulic fluid fed from a hydraulic pump (not shown) and causes the blade 5 to move up and down. The travel device 3 is a travel device having a pair of crawlers 3*a* and is attached to the vehicle body frame 4. The vehicle body frame 4 has the driver's cab 7 and an engine compartment 8.

A seat and/or operation devices (not shown) are mounted in the driver's cab 7. The engine compartment 8 is disposed in front of the driver's cab 7. The engine compartment 8 is disposed between the pair of crawlers 3*a*, and the width of the engine compartment 8 is therefore limited in the gap between the pair of crawlers 3*a*. The engine compartment 8 has an upper surface 11, a first sidewall 12, and a second sidewall 13, as shown in FIG. 2.

The upper surface 11 covers over the engine compartment 8. The upper surface 11 is formed so that the width decreases in accordance with proximity to the driver's cab 7. The rear end of the upper surface 11 faces the front of the driver's cab 7. The upper surface 11 has a detachable upper cover 14.

The upper cover 114 includes a top plate 141, a first side plate 142, and a second side plate 143. The top plate 141 is a main portion of the upper cover 14, and covers over a later-described exhaust gas treatment device 33 and an air cleaner 34 (see FIG. 5). An exhaust pipe 8*a* and an intake pipe 8*b* are inserted through the top plate 141. The exhaust pipe 8*a* and intake pipe 8*b* are set off-center to the first sidewall 12 side with reference to a center line P along the longitudinal direction of the bulldozer 1. The first side plate 142 extends downward from the left end of the top plate 141. The first side plate 142 is disposed between the top plate 141 and the first sidewall 12. The second side plate 143 extends downward from the right end of the top plate 141. The second side plate 143 is disposed between the top plate 141 and the second sidewall 13. A detailed configuration of the upper cover 14 is later described.

The first sidewall 12 is provided along the longitudinal direction and covers the left of the engine compartment 8. The first sidewall 12 has a detachable first side cover 15. The second sidewall 13 is provided along the longitudinal direction and covers the right of the engine compartment 8. The second sidewall 13 has a detachable second side cover 16. The first sidewall 12 and the second sidewall 13 have mutually left-right symmetrical shapes with reference to the center line P along the longitudinal direction of the bulldozer 1, and are set at a distance from each other in the vehicle width direction.

Figure 3:
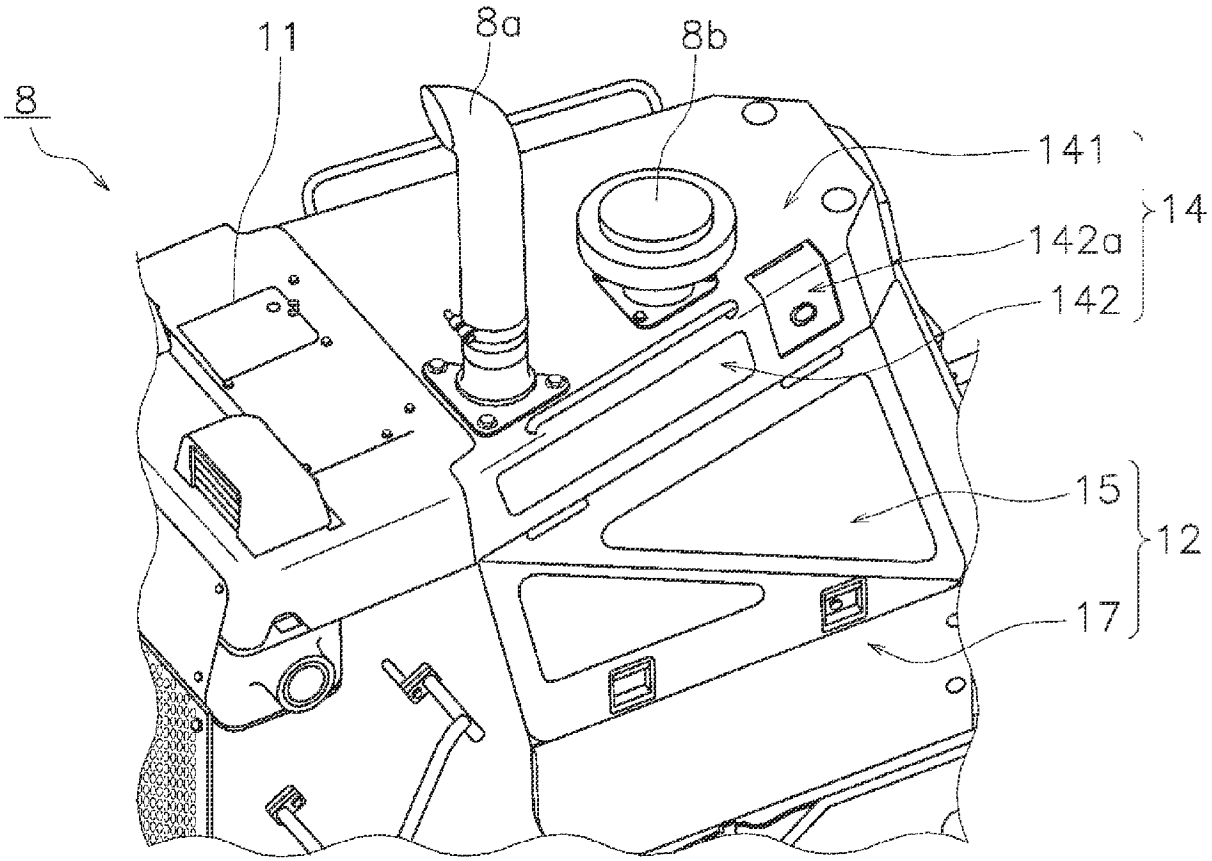
FIG. 3 is a perspective view of an engine compartment 8 according to an embodiment as seen from above left.
Figure 4:
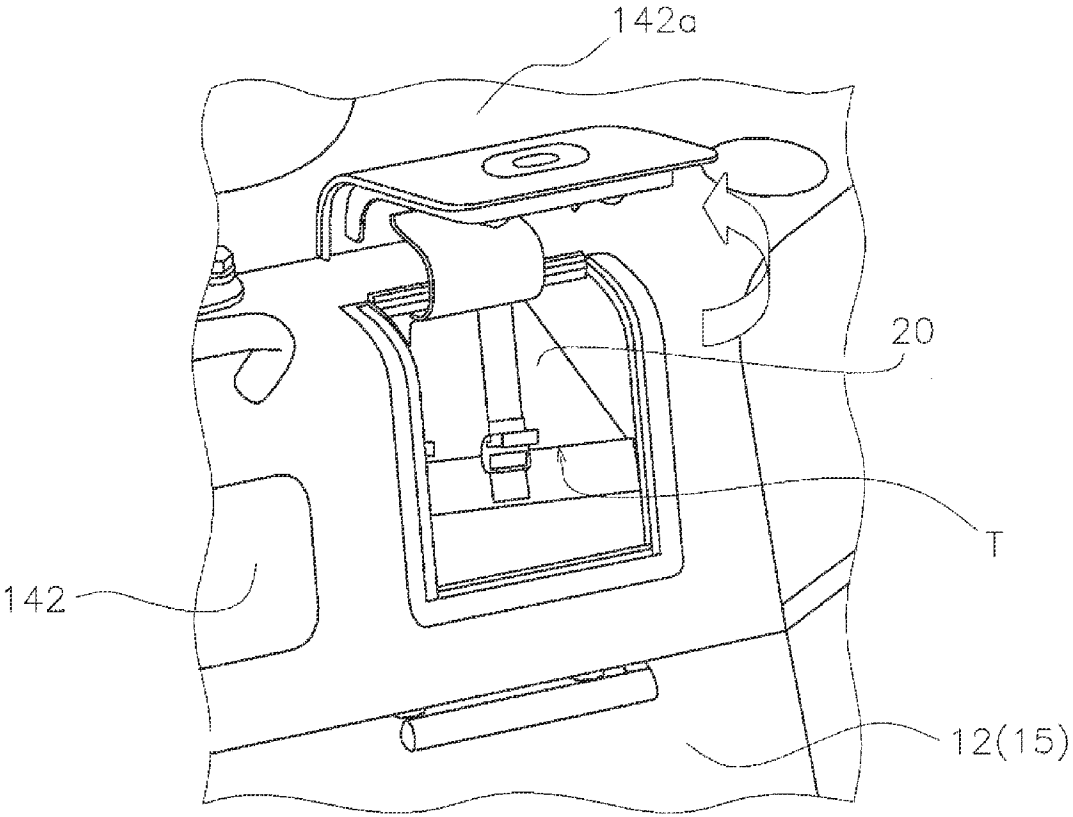
FIG. 4 is a partial enlarged view of FIG. 3.

Here, FIG. 3 is a perspective view of the engine compartment 8 as seen from above left. FIG. 4 is a partial enlarged view of FIG. 1A lid 142*a* in a closed state is shown in FIG. 3, and the lid 142*a* in an open state is shown in FIG. 4.

The exhaust pipe 8*a* and intake pipe 8*b*, which protrude upward from the upper cover 14, are inserted through the top plate 141 of the upper cover 14, as shown in FIG. 3. The exhaust pipe 8*a* is connected to the exhaust gas treatment device 33 (see FIG. 6) in the engine compartment 8. The intake pipe 8*b* is connected to the air cleaner 34 (see FIG. 6) in the engine compartment 8.

The first sidewall 12 comprises a detachable lower cover 17 disposed below the first side cover 15, as shown in FIG. 3.

The first side plate 142 of the upper cover 14 has an opening T and a lid 142*a*, as shown in FIG. 4. The opening T is formed in the rear end part of the first side plate 142. The opening T leads to a tool-storage part 20 formed inside the upper cover 14. The lid 142*a* is attached so as to cover the opening T, and is capable of opening and closing the opening T. In the present embodiment, the lid 142*a* is capable of pivoting in the vertical direction. The worker can open and dose the lid 142*a*, and/or remove tools, while standing on the crawler 3*a* when the serviceable equipment is to be inspected and serviced.

Internal Configuration of Engine Compartment 8

Figure 5:
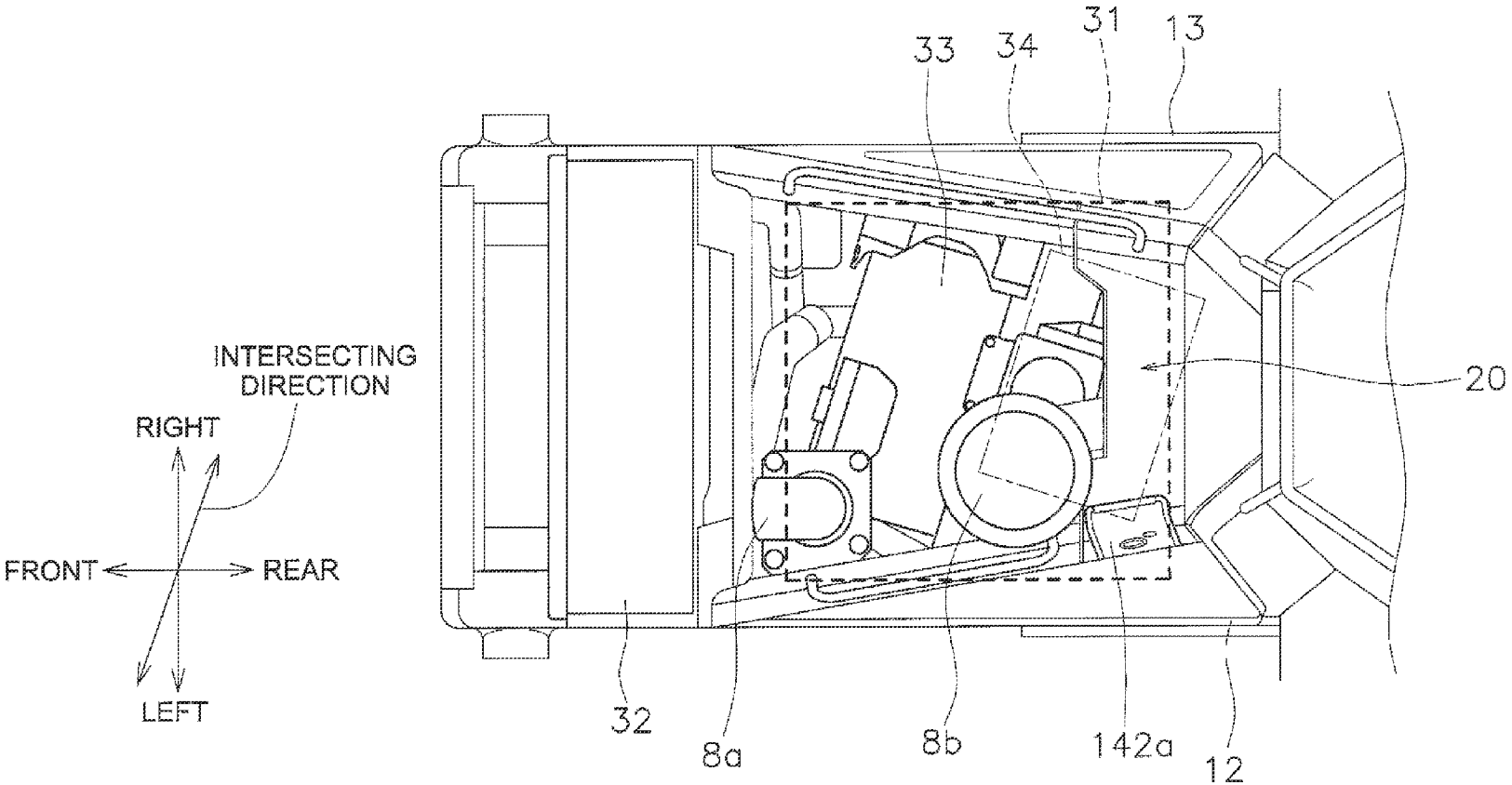
FIG. 5 is a top transparent view showing the internal configuration of the engine compartment 8 according to an embodiment.
Figure 6:
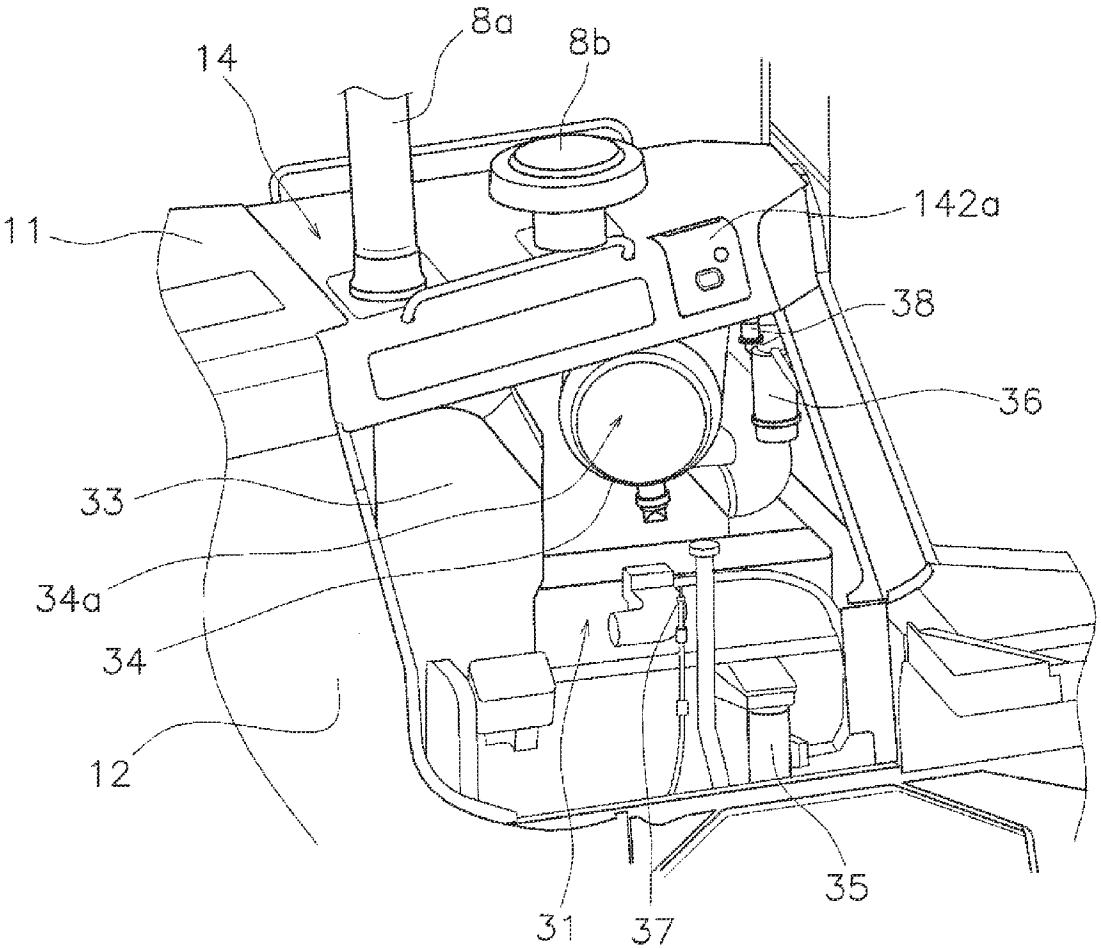
FIG. 6 is a side view showing the internal configuration of the engine compartment 8 according to an embodiment.

FIG. 5 is a top transparent view showing the internal configuration of the engine compartment 8 according to an embodiment. FIG. 6 is a side view showing the internal configuration of the engine compartment 8 according to an embodiment. In FIG. 6, the first side cover 15 and the lower cover 17 are shown in a detached state.

Stored in the engine compartment 8 are an engine 31, a radiator 32, the exhaust gas treatment device 33, the air cleaner 34, a fuel main filter cartridge 35, a fuel pre-filter cartridge 36, an engine oil level gauge 37, and a dust indicator 38.

The engine 31 is, e.g., a diesel engine, and is a drive source for driving the above-described hydraulic pump and/or the travel device 3. The engine 31 is disposed below the exhaust gas treatment device 33 and the air cleaner 34.

The radiator 32 is disposed in front of the engine 31 and the exhaust gas treatment device 33. The radiator 32 is a device for cooling coolant circulating over a path that is bounded on one side by the engine 31. The radiator 32 is configured so as to allow air to pass in the longitudinal direction. The radiator 32 is disposed substantially along the vehicle width direction.

The exhaust gas treatment device 33 is a device for treating exhaust gas from the engine 31, and is a treatment device that uses a diesel particulate filter scheme. The exhaust gas treatment device 33 uses a filter to scavenge particulate matter included in the exhaust gas, and the scavenged particulate matter is incinerated by a heater added to the filter. The exhaust gas treatment device 33 is formed in a substantially cylindrical shape, and is disposed above the engine 31 and in front of the air cleaner 34. The exhaust gas treatment device 33 is disposed diagonally along the intersecting direction that intersects the vehicle width direction. Specifically, the air cleaner 34 is disposed so that the end part (left side end part) of the first side cover 15 side is positioned farther forward than the end part (right side end part) of the second side cover 16 side as viewed from above. The exhaust pipe 8*a* is connected to the tope left side front end part of the exhaust as treatment device 33 as viewed from above.

The air cleaner 34 is disposed above the engine 31 and rearward of the exhaust gas treatment device 33. The air cleaner 34 is disposed diagonally along the intersecting direction in the same manner as the exhaust gas treatment device 33. The air cleaner 34 has an element replacement port 34*a* for removing and inserting an element, as shown in FIG. 6. The intake pipe 8*b* is connected to the top left side front end part of the air cleaner 34 as viewed from above.

The tool-storage part 20 and the lid 142*a* of the upper cover 14 are disposed rearward of the intake pipe 81). The details of the arrangement are as follows. The exhaust gas treatment device 33 and the air cleaner 34 are disposed diagonally along the intersecting direction that intersects the vehicle width direction. The exhaust pipe 8*a* is disposed on the front side end part of the exhaust gas treatment device 33, and the intake pipe 8*b* is disposed on the front side end part of the air cleaner 34. The lid 142*a* is attached to the first side plate 142 of the upper cover 14 rearward of the intake pipe 8*b*. The tool-storage part 20 is disposed along the vehicle width direction on the vehicle side of the lid 142*a*. The configuration of the tool-storage part 20 is later described.

The fuel main filter cartridge 35 filters fuel to be fed to the engine 31. The fuel main filter cartridge 35 must be replaced at predetermined intervals (e.g., 1000 hours).

The fuel pre-filter cartridge 36 filters, in advance, fuel to be fed to the engine 31. The fuel pre-filter cartridge 36 must be replaced at predetermined intervals (e.g., 500 hours).

The engine oil level gauge 37 is a level gauge for checking the amount of oil in the engine oil pan. The dust indicator 38 displays the degree of soiling of the element of the air cleaner 34.

Here, the element replacement port 34*a*, the fuel main filter cartridge 35, the fuel pre-filter cartridge 36, the engine oil level gauge 37, and the dust indicator 38 (hereinafter generically referred to as "serviceable equipment") are disposed inside the first sidewall 12. Accordingly, the serviceable equipment can be accessed from the exterior by detaching the first side cover 15.

Internal Configuration of Upper Cover 14

Figure 7:
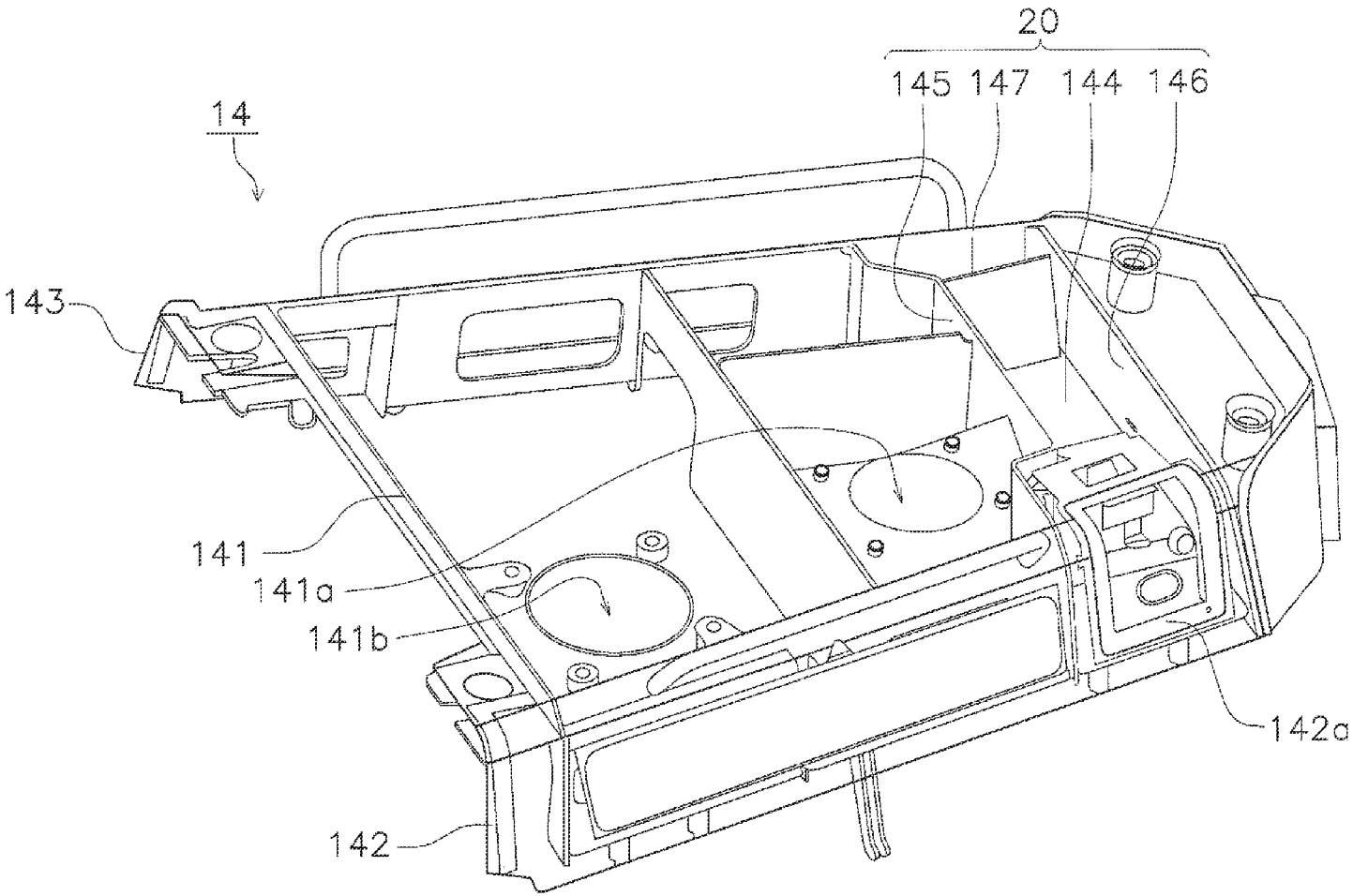
FIG. 7 is a perspective transparent view showing the internal configuration of the upper cover 14 according to an embodiment.

FIG. 7 is a perspective transparent view showing the internal configuration of the upper cover 14 according to an embodiment.

The upper cover 14 comprises a first coupling plate 144, a second coupling plate 145, a third coupling plate 146, and a partition plate 147, constituting the tool-storage part 20.

The first coupling plate 144 is a plate-shaped member disposed substantially horizontally along the vehicle width direction. The first coupling plate 144 is coupled below the top plate 141 to the first side plate 142 and the second side plate 143. The first coupling plate 144 functions as a reinforcement member for suppressing deformation of the upper cover 14. The first coupling plate 144 constitutes the bottom plate of the tool-storage part 20.

The second coupling plate 145 is a plate-shaped member disposed substantially vertically along the vehicle width direction. The second coupling plate 145 is coupled below the top plate 141 to the first side plate 142 and the second side plate 143. Also, the second coupling plate 145 is erectly disposed on the front end part of the first coupling plate 144. The second coupling plate 145 functions as a reinforcement member for suppressing deformation of the upper cover 14. The second coupling plate 145 constitutes the front plate of the tool-storage part 20.

The third coupling plate 146 is a plate-shaped member disposed substantially vertical along the vehicle width direction. The third coupling plate 146 is coupled below the top plate 141 to the first side plate 142 and the second side plate 143. Also, the third coupling plate 146 is provided erectly on the rear end part of the first coupling plate 144. The third coupling plate 146 functions as a reinforcement member for suppressing deformation of the upper cover 14. The third coupling plate 146 constitutes the rear plate of the tool-storage part 20.

The partition plate 147 is erectly disposed on the right end part of the first coupling plate 144, and is coupled to the second coupling plate 145 and the third coupling plate 146.

Formed in the top plate 141 are a first through-hole 141*a* through which the exhaust pipe 8*a* is inserted, and a second through-hole 141*b* through which the intake pipe 8*b* is inserted.

Operation and Effect (1) The bulldozer 1 according to the embodiment comprises an air cleaner 34 disposed rearward of the exhaust gas treatment device 33, an intake pipe 8*b* protruding upward from the upper cover 14 and connected to the air cleaner, and a tool-storage part 20 disposed rearward of the intake pipe 8*b*.

In this manner, the tool-storage part 20 is set at a distance from the exhaust gas treatment device 33. In particular, the intake pipe 8*b* is disposed between the tool-storage part 20 and the exhaust gas treatment device 33. Accordingly, it is possible to suppress the transfer of heat generated from the exhaust gas treatment device 33 to the tool-storage part 20, even when the exhaust gas treatment device 33 has reached a high temperature. Therefore, the tool-storage part 20 can be kept from heating up.

(2) The upper cover 14 has an opening T that leads to the tool-storage part 20, and a lid 142*a* that is capable of opening and closing the opening T.

Therefore, the tool-storage part 20 can be directly accessed from the exterior of the engine compartment 8, and accordingly there is no need to remove the upper cover 14. Therefore, operation can be facilitated.

(3) The opening T is disposed above the first sidewall 12. Serviceable equipment is disposed inside the first sidewall 12.

In this manner, the opening T is disposed in a location in which the serviceable equipment is concentrated (in the present embodiment, the left side of the engine compartment 8), and the distance that the worker moves during inspection and service can therefore be reduced. Accordingly, work efficiency can be further improved.

(4) The upper cover 14 has a first coupling plate 144 that functions as a reinforcement member for suppressing deformation of the upper cover 14. The first coupling plate 144 constitutes the bottom plate of the tool-storage part 20.

In this manner, the bottom plate of the tool-storage part 20 is used as a reinforcement member and it is therefore not necessary to separately provide a reinforcement member.

(5) The upper cover 14 has a second coupling plate 145 that functions as a reinforcement member for suppressing deformation of the upper cover 14. The second coupling plate 145 constitutes the front plate of the tool-storage part 20. Also, the upper cover 14 has a third coupling plate 146 that functions as a reinforcement member for suppressing deformation of the upper cover 14. The third coupling plate 146 constitutes the rear plate of the tool-storage part 20.

In this manner, the front plate and rear plate of the tool-storage part 20 are used as reinforcement members, and therefore it is not necessary to separately provide a reinforcement member.

Other Embodiments

An embodiment of the present invention was described above, but the present invention is not limited to the embodiment described above; various modifications can be made within a range that does not depart from the spirit of the invention.

(A) In the embodiment described above, a description is provided using a bulldozer 1 as an example of a work vehicle, but no limitation is imposed thereby. A wheel loader, an excavator, or the like are other examples of a work vehicle.

(B) In the embodiment described above, the exhaust gas treatment device 33 is a diesel particulate filter, but no limitation is imposed thereby. The exhaust gas treatment device 33 may be, e.g., a device that uses a selective catalytic reduction scheme, a device that uses an oxidation catalyst (OC) scheme, or a device that uses a lean NOx trap (LNT) scheme.

(C) In the embodiment described above, the opening T is formed in the first side plate 142 of the upper cover 14 and is disposed above the first sidewall 12, but no limitation is imposed thereby. The opening T may be formed in the second side plate 143 and disposed above the second sidewall 13. In this case, the right end part of the exhaust gas treatment device 33 and the air cleaner 34 is positioned further forward than the left end part as viewed from above, which is the reverse of that described above. The opening T may be formed in the top plate 141.

In accordance with the illustrated embodiments, the tool-storage, part can be kept from being overheated by the exhaust gas treatment device; therefore, the illustrated embodiments are useful in the field of work vehicles comprising the exhaust gas treatment device.

What is claimed is:

1. A work vehicle comprising:

an engine compartment having a first sidewall, a second sidewall and an upper cover, the first sidewall and the second sidewall being set at a distance from each other in a vehicle width direction, the upper cover disposed on the first sidewall and the second sidewall and constituting a tool-storage part;

an engine disposed in the engine compartment;

an exhaust gas treatment device disposed above the engine in the engine compartment;

an exhaust pipe that is connected to the exhaust gas treatment device inside the engine compartment and arranged to protrude upward from the upper cover;

an air cleaner disposed above the engine in the engine compartment and rearward of the exhaust gas treatment device; and an intake pipe that is connected to the air cleaner in the engine compartment and arranged to protrude upward from the upper cover, the tool-storage part being disposed rearward of the intake pipe, the upper cover having an opening and a lid, the opening leading to the tool-storage part, the lid configured to open and close the opening, the exhaust gas treatment device disposed diagonally to the vehicle width direction, the exhaust pipe disposed on a front end part of the exhaust gas treatment device, the intake pipe disposed rearward of the exhaust pipe, and the lid disposed rearward of the intake pipe.

2. The work vehicle according to claim 1, wherein the opening is disposed above the first sidewall; and at least one among an element replacement port for the air cleaner, a fuel filter cartridge, and an engine oil level gauge is disposed on the inside of the first sidewall.

3. The work vehicle according to claim 1, wherein the upper cover has a top plate, a first side plate, a second side plate and a first coupling plate, the top plate covering over the exhaust gas treatment device and the air cleaner, the first side plate leading to the top plate and disposed between the top plate and the first sidewall, the second side plate leading to the top plate and disposed between the top plate and the second sidewall, and the first coupling plate being coupled to the first side plate and the second side plate below the top plate, the first coupling plate constituting a bottom plate of the tool-storage part.

4. The work vehicle according to claim 3, wherein the upper cover has a second coupling plate and a third coupling plate, the second coupling plate being coupled to the first side plate and the second side plate below the top plate and erectly disposed in relation to the first coupling plate, the second coupling plate constituting a front plate of the tool-storage part, and the third coupling plate being coupled to the first side plate and the second side plate below the top plate and erectly disposed in relation to the first coupling plate, the third coupling plate constituting a rear plate of the tool-storage part.

5. The work vehicle according to claim 1, wherein the lid is arranged to pivot in a vertical direction.

6. The work vehicle according to claim 3, wherein the upper cover further includes an opening that is provided in the first side plate and leads to the tool-storage part, and a lid that is configured to open and close the opening.

7. The work vehicle according to claim 4, wherein the upper cover further includes an opening that is provided in the first side plate and leads to the tool-storage part, and a lid that is configured to open and close the opening.

8. The work vehicle according to claim 3, wherein the upper cover further includes an opening that is provided in the second side plate and leads to the tool-storage part, and a lid that is configured to open and close the opening.

9. The work vehicle according to claim 4, wherein the upper cover further includes an opening that is provided in the second side plate and leads to the tool-storage part, and a lid that is configured to open and close the opening.

* * * * *